United States Patent [19]

Bassompierre-Sewrin

[11] 4,280,289

[45] Jul. 28, 1981

[54] UNDERWATER TRENCHING MACHINE FOR BURYING PIPELINE AND THE LIKE

[75] Inventor: Christian C. Bassompierre-Sewrin, Embrun, France

[73] Assignee: Martech International, Inc., Houston, Tex.

[21] Appl. No.: 79,358

[22] Filed: Sep. 27, 1970

[51] Int. Cl.[3] ..... F16L 1/00; E02F 5/02

[52] U.S. Cl. ..... 37/63; 405/160; 405/163; 104/118; 105/141; 105/215 R

[58] Field of Search ..... 37/61–63; 405/158–165

[56] References Cited

U.S. PATENT DOCUMENTS

| | | | |
|---|---|---|---|
| 3,004,392 | 10/1961 | Symmank | 37/63 X |
| 3,333,432 | 8/1967 | Hale et al. | 37/63 X |
| 3,717,003 | 2/1973 | Bates, Jr. et al. | 37/63 X |
| 3,732,701 | 5/1973 | Lynch | 405/162 |
| 3,877,237 | 4/1975 | Normon | 405/163 X |
| 3,978,679 | 9/1976 | Lecomte | 405/159 |
| 4,112,695 | 9/1978 | Chang et al. | 405/163 |
| 4,127,950 | 12/1978 | Tillinghast et al. | 37/62 |

FOREIGN PATENT DOCUMENTS

| | | | |
|---|---|---|---|
| 1399802 | 7/1975 | United Kingdom | 37/62 |

*Primary Examiner*—Clifford D. Chowder
*Attorney, Agent, or Firm*—Bernard A. Reiter

[57] ABSTRACT

An underwater trenching machine comprising a carriage and a pair each of fore and aft pivotal frames, each of which carries a drive roller means for intimately contacting the pipeline, said front and rear frames being adapted to mutually exclusively pivot outwardly upon command so that the frame carrying the roller means resting at that time on the pipeline takes over the drive function performed by the roller means on both pair of frame means theretofore, and further including improved jet legs each divided into multiple sections for enabling differential water velocity while minimizing water pressure loss through the length thereof, all while the machine is maintained at a predetermined buoyance and attitude.

7 Claims, 5 Drawing Figures

UNDERWATER TRENCHING MACHINE FOR BURYING PIPELINE AND THE LIKE

BACKGROUND OF THE INVENTION

Prior art trenching machines for trenching pipelines are known to have serious drawbacks. Some trenchers, for example, are self-propelled on hydraulically driven wheels which ride on the coating of the pipeline. These wheels are hydraulically pressed against the surface of the pipe for the purpose of not only developing sufficient traction to move the trenching machine, but also for the purpose of riding over surface obstacles in the pipeline itself, such as anodes or merely riding over areas of varying diameter.

It is also commonly known that trenching machines must work in a wide range of soil conditions from extremely soft sand to hard clay and the like. The cutting requirements are thus similarly broad. And in case of elongate nozzle assemblies, vertically oriented on the trenching machine, it has been found that substantial pressure drops through the length of the cutting nozzles produces a diminished cutting action from one end of the cutting assembly toward the low pressure end, thus resulting in an inconsistent cutting action in which one end of the cutting assembly is more effective than the other end due to the pressure drop through the length of the nozzle assembly.

Due to the necessity to drive the trenching machine over the surface of the pipeline, and simultaneously produce sufficient cutting action by the nozzles or other cutters, substantial power requirements are necessary. Since, as indicated above, the trenching machines must work in hard, as well as soft soils, the necessary power requirement at any given time may be substantially greater than required. Thus, the prime movers of known trenching machines are provided with complex control mechanisms that are characterized by gears, clutches and control knobs for the purpose of preventing the cutters from stalling and enabling adjustment of the power to the cutter assemblies. Among the consequences of these substantial energy requirements are the necessity for carrying large diesel engines on the floating vessel accompanying the trenching machines, greater energy requirements for operating the trencher, and relative inefficiency in operation of the trenching machine on a basis of cost per unit of foot trenched.

SUMMARY OF THE INVENTION

It is, therefore, a general object of this invention to provide an improved trencher for entrenching a pipeline under the bed of a body of water.

It is another object of the present invention to provide a trenching machine on which the drive wheels exert a nominal pressure on the surface of the pipeline.

It is yet a further object of the invention to provide a trenching machine in which the drive wheels are characterized by a fore and aft set, either or both of which can act upon the pipeline in manner sufficient to drive the trenching machine.

It is still another object of the invention to provide a trenching machine which is characterized by a pair of fore and aft each drive wheels which may be pivoted outwardly from the surface of the pipeline when an obstacle on the pipeline surface is encountered.

A still further feature and object of the invention is to provide a trenching machine in which either the fore or aft pair of drive wheels may be used to drive the trenching machine, and in which operation of the machine is so intended.

A still further feature of the invention resides in an improved dual section nozzle assembly design for minimizing pressure drop between different sections of the cutting nozzle.

A still further feature and advantage of the invention resides in a trenching machine system having surface control means 4 alternatively and selectively moving either of a pair of tandem drive rollers over an obstruction on a submerged pipeline while exerting minimal compressive force on the pipeline coating.

Yet another feature of the invention resides in an apparatus for presenting a positive recognition of the position of a trenching machine when mechanical distance counting methods are inoperative.

These and numerous other features and advantages of the invention will become apparent upon a careful reading of the following detailed description, claims and drawings, wherein like numerals denote like parts in the several views, and wherein:

DETAILED DESCRIPTION OF THE TRENCHING MACHINE

Figure 1:
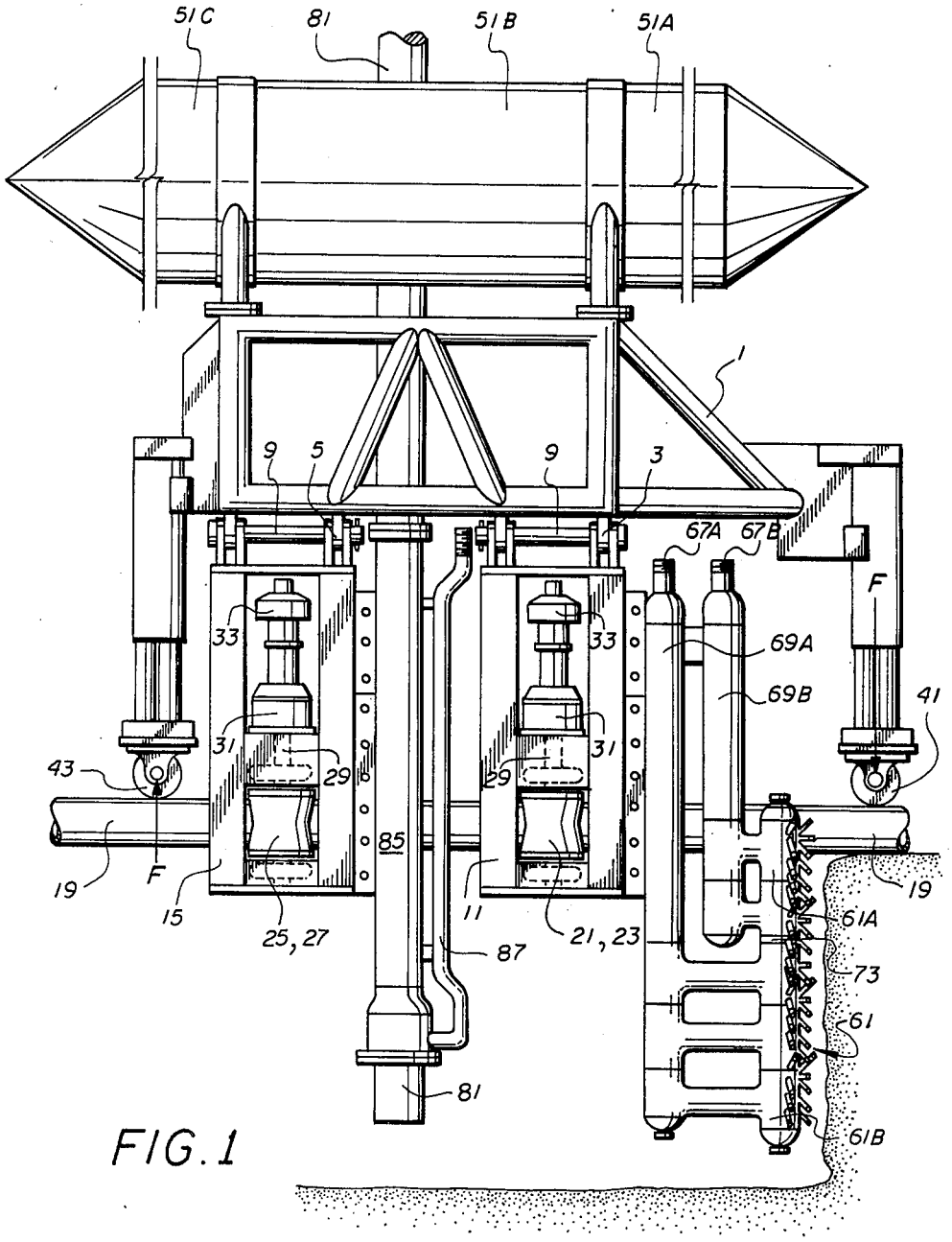
FIG. 1 is a side elevation view of the improved trenching machine of the invention.
Figure 2:
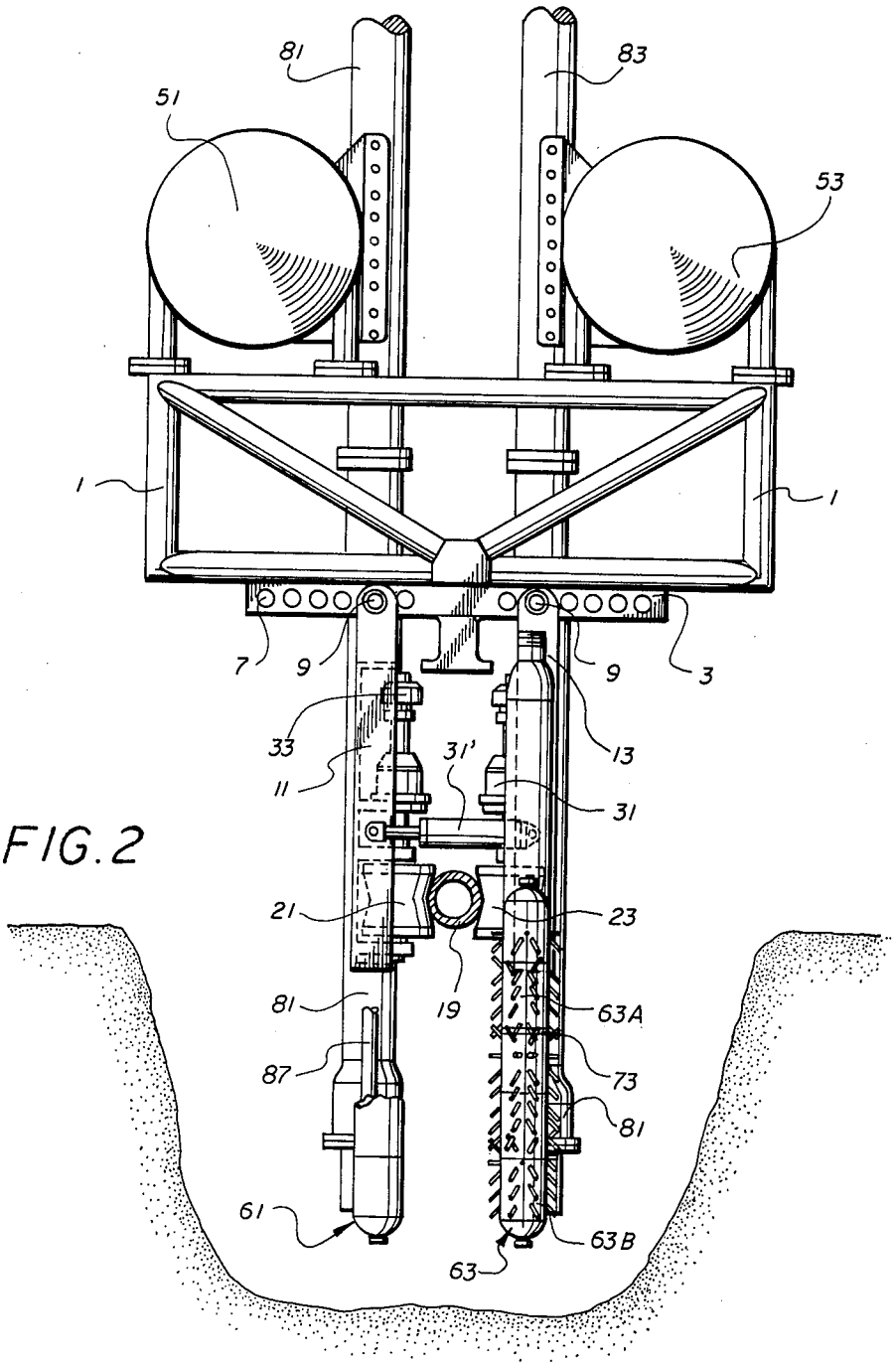
FIG. 2 is a front view of the trenching machine of FIG. 1.

With reference now to FIGS. 1 and 2, there is shown the exemplary design of the trenching machine of the invention and consisting of a central structural carriage means 1 characterized by a framework of sufficient structural integrity to perform the necessary trenching functions hereinafter described. Welded or otherwise affixed to the lower surface of carriage means 1 is a pair of parallel sub-frame support means 3, 5, both disposed transversely of the longitudinal axis or center line of the carriage means 1. Each of the sub-frame support means 3, 5, is characterized by a plurality of aligned axle bores 7 on each side of the center line. Suspended from the axle bores 7 by means of a pivot axle 9 is a pair of fore frame means 11, 13, and a pair of aft frame means 15, 17 (the latter not shown). Fore frame means 11 and aft frame means 15 are disposed in aligned arrangement with one another in that they are suspended by aligned pivot axles 9, as are fore frame means 13 and aft frame means 17, which are similarly disposed in aligned arrangement with one another through identically positioned pivot axles, all with respect to the center line of the carriage means. The position of the fore and aft frame means 11, 13 and 15, 17, with respect to the center line of the carriage, may be adjustable by moving the two pair of frame means to a differently positioned axle bore, farther or nearer the center line of the carriage means 1, this depending upon the relative diameter of the pipe 19 on which the trenching machine is moving.

The frame means 11, 13, each carry a roller means 21, 23, configured to engage a portion of the circumference of a pipe 19. The rear rollers means 25, 27, are likewise carried respectively by frame means 15, 17. Each of the four roller means 21, 23, and 25, 27, are carried by a substantially vertically oriented drive axle 29 engaged by gear means 31 which in turn is driven by a motor 33. The roller means 21, drive axle 29, gear means 31 and motor 33, all constitute and comprise the power drive means mounted each, respectively, in the four pivotally mounted, suspended frame means 11, 13, 15 and 17. The frame means 11 and 13 are integrally coupled to one another by a hydraulically operated piston and cylinder means 31. Similarly, the aft frame means 15, 17, are coupled to one another by a similar piston and cylinder means. The piston and cylinder means 31 are each pivotally connected to their respective frame means so as to permit expansion and/or contraction of each frame means with respect to the other about the pivot axle 9 of each of the respective frame means. Likewise, the aft frame means 15, 17, similarly operate with respect to one another. All of the four frame means are remotely controlled, with respect to the actuation of piston and cylinder means 31, from a control panel aboard a vessel floating on the surface of the body of water above the trenching machine. By means of conventional and well known instrumentation (not shown), the fore roller means 21, 23, and 25, 27 are designed to exert a discrete and specific pressure on the pipe 19, and as a consequence thereof, each of the power roller means will persist in applying a given fraction force to the pipe sufficient to motivate the trenching machine down the length of the pipe, unless and until an obstacle in the path of the rollers occurs or until a variance in the pipeline diameter is encountered. At such time, an increased pressure is monitored on gauges on the control panel in the vessel on the surface of the body of water, and at which time simultaneously, the motors 33 are automatically deactivated, thus terminating the motive power of the fore and aft roller means. At such time, the operator of the trencher means monitoring the movement of the trenching machine conducts the method of operation of the machine thereafter in accordance with the disclosure set forth hereinafter.

Further affixed to and extending from both the fore and aft ends of carriage means 1 are the fore support roller means 41 and aft support roller means 43, both of which are designed to substantially support the trenching means on the surface of the pipeline 19. Because of the substantial weight of the machine, however, this being in the range of fifteen thousand pounds more or less, it becomes necessary to neutralize the weight of the trenching machine on the pipeline. This is accomplished by attachment to the carriage means 1 of a plurality of air tanks 51, 53, each of which is characterized by several or more compartments, such as 51*a*, 51*b* and 51*c* (see FIG. 1), for receiving selective amounts of compressed air for inducing predetermined angles of trim and/or tilt to the trenching machine. Each of the compartments in the tanks 51, 53, are selectively accessible by port means (not shown), which are normally coupled to hoses communicating with the surface or which may be accessed by divers beneath the surface of the body of water.

A further feature of the trenching machine herein shown resides in the nozzle assembly 61, 63, adjustably supported at the fore end of the trenching machine. The nozzle assembly is attached in such manner as to enable adjustability of the depth of the nozzle cutting action, this depth being dependent upon the diameter of the pipeline, characteristic of the sub-surface and generally the magnitude of depth at which the pipeline is to be buried. Adjustability of the depth is accomplished by attachment of the nozzle means on the adjustable nozzle supports, which are in themselves fixedly attached, such as by welding to the fore end of fore frame means 11, 13. Thus, depending upon the size of the pipeline 19 and the depth at which it is to be buried, the nozzle assemblies 61, 63, may be raised or lowered by detachment and reattachment to the adjustable nozzle supports 67, the connection being made by bolts or the like extending through one of a plurality of vertically arranged bores extending into the adjustable nozzle support means 67. The cutting action of the nozzle means 61, 63, is accomplished by a multiplicity of angularly directed nozzles 65 selectively disposed in both the upper nozzle assemblies 61*a*, 63*a*, and lower nozzle assemblies 61*b*, 63*b*. Water inlet ports 67*a* and 67*b* are disposed proximate the upper end of supply pipes 69*a* and 69*b*, respectively. The upper nozzle means and lower nozzle means 61*a*, 63*a*, and 61*b*, 63*b* respectively, are supplied by the water inlet ports 67*b* and 67*a* respectively, so that there is no loss of water jet pressure through the length of the nozzle assembly. Conventional provision for a single water inlet port to supply the jet pressure through the length of the nozzle assembly results in a diminution of nozzle pressure at the end of the nozzle assembly remote from the source of supply such that variability in the digging ability or cutting ability of the nozzle occurs. More specifically, superior cutting occurs at or adjacent the nozzles most proximate to the water supply source where the pressure is highest. Construction of a pair of nozzle assemblies, upper and lower, as shown in FIG. 1 as 61*a* and 61*b* with respective water inlet ports supplying each of the plurality of nozzles in each assembly, obviates the diminution of water pressure and provides for efficient and equal cutting characteristics at both the upper and lower end of the nozzle assemblies. Moreover, through valving controls, or other appropriate means, it becomes possible to selectively control the water flow to either the right or left nozzle assemblies and/or to either the upper or lower nozzle means thereof. The upper and lower nozzle means may, for structural integrity purposes, be integrally connected to one another by appropriate connection means 73.

The slurry produced by the high pressure introduction of water through nozzles 61 is removed from the trenching area by a plurality of vertically adjusted eductor pipes 81, 83 (see FIGS. 1 and 2). The eductor pipes are adjustably secured to adjustable eductor support means 85 affixed, such as by welding, to the side of the frame means 15, 17. The eductor pipes receive air through air supply tubes 87 and function to suction the slurry from the floor of the body of water as it is produced by the cutting action of water nozzles 65.

Figure 4:
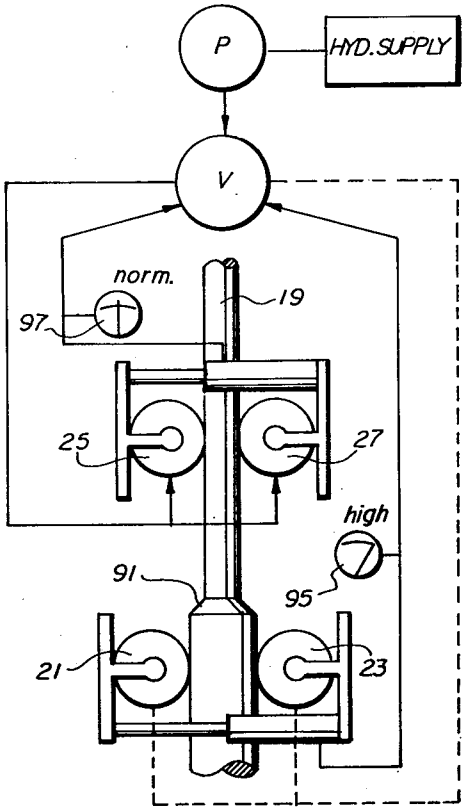
FIG. 4 is a schematic illustration of the hydraulic control system for the drive rollers after encountering a pipeline obstacle.
Figure 3:
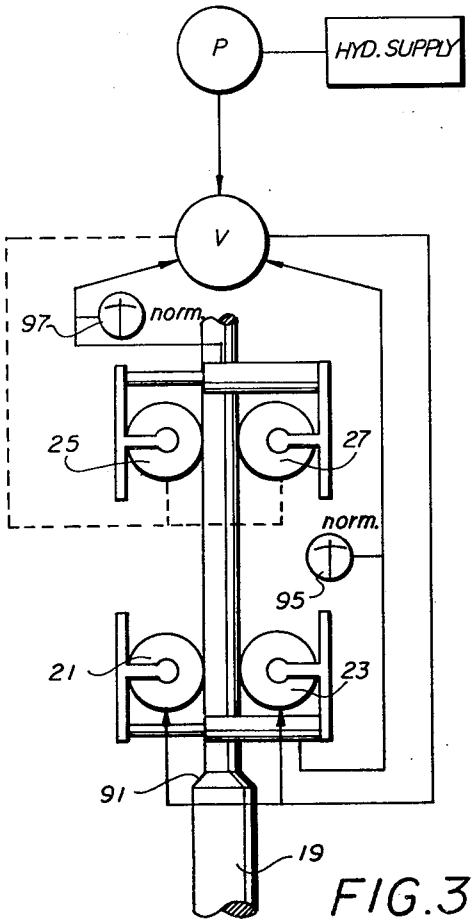
FIG. 3 is a schematic illustration of the hydraulic control system for the drive rollers prior to encountering a pipeline obstacle.

In operation, the trenching machine may approach an anode in the pipeline or other diameter enlargement or obstacle 91, as best shown in FIGS. 3 and 4. When the fore roller means 21, 23, abut such obstacle 91, a pressure increase on the roller means occurs and is monitored on appropriate pressure gauges 95 on a control panel on the vessel on the surface of the body of water. An increase in the pressure actuates instrumentation which deactivates the roller drive system of such fore roller means 21, 23. The operator at the control panel then actuates a hydraulic supply system, shown schematically, which transmits sufficient pressure through valving means V (schematically shown) to the fore frame means and to the piston and cylinder means 31 which couples the fore frame means together causing expansion of the piston in the cylinder and concomitant outward pivotal movement of the fore frame means away from and outwardly of the center line of the carriage means 1, thus removing the fore roller means 21, 23, from contact with the pipeline 19. This relieves the pressure means evidenced on the pressure gauge 95 for the fore roller means and takes the fore roller means out of contact with the pipeline sufficiently to move over the obstacle. At such time, the aft roller means 25, 27, continue their driving function, thus moving the trenching machine continually forward (see FIG. 4) until the aft roller means 25, 27, come into abutting contact with the obstacle 91 on the pipeline, thereat manifesting an increased pressure on aft pressure gauge 97. At this time, the operator monitoring the system at the console on the vessel on the surface of the body of water actuates the valving means coupled to the hydraulic supply so as to draw the piston and actuator 31 of the fore frame means into their closing motion, thus causing pivotal movement of such frame means about the pivot axles 9 toward one another until the roller means 21, 23 move into abutting relation with the pipeline. At such time, appropriate valving means at the control console are actuated by the operator to hydraulically expand the piston and cylinder coupling the aft frame means to each other, thus expanding outwardly such frame means about their respective pivot axles 9 with respect to each other while the fore roller means and power drive system therefor continue to move the trenching machine forwardly a sufficient distance to ensure that the aft roller means 25, 27 have passed over the obstacle 91. At such time, the valving means is actuated to close the aft frame means so that the rollers come into traction contact with the pipeline.

Figure 5:
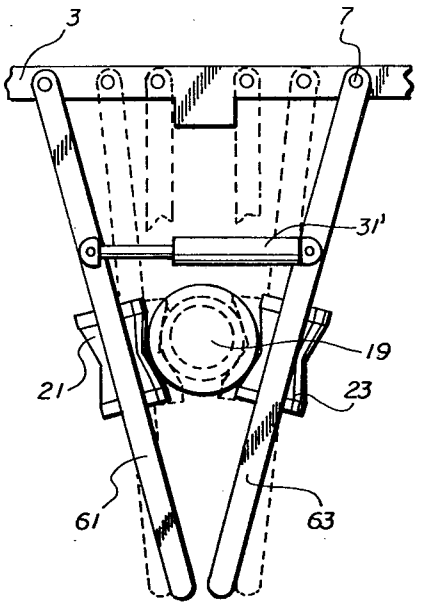
FIG. 5 is a front view, illustrating in ghost, varied positions of the frame means as they may be set to accommodate different diameter pipelines.

As shown in FIG. 5, the trenching machine may readily be adapted for use in a wide variety of pipeline diameters. Since the fore roller means 21, 23 and aft roller means 25, 27 exert their most effective traction when in diametrically opposed position, respectively, to one another on the pipeline, it becomes desirable to be able to move the right fore frame means 11 outwardly of the center line, and likewise move the left fore frame means 13 so that a larger diameter pipeline may be accommodated therebetween while maintaining opposing contacting relation on the pipeline by the roller means respectively carried by each frame means. The aft frame means 15, 17 would, of course, be correspondingly moved by repositioning the respective pivot axles 9 in the outwardly positioned axle bores 7 in the subframe support means 3, 5.

It is thus easily recognized that the present invention is designed for facile adaptation to a wide range of pipeline diameters while maintaining the ability to readily overcome pipeline obstacles in reliable manner and in so doing exerting a predetermined governable pressure on the pipeline surface. It will be further recognized that the structure herein disclosed is set forth as an example of the principles of the invention and that substitutions and modifications to the structure so disclosed may be adapted without departing from the spirit of the invention, and the scope of the claims appended hereto.

Therefore, that which is claimed and desired to be secured by United States Letters Patent is:

1. In a trenching apparatus for excavating a path in the floor of a body of water for receiving therein a pipeline or the like comprising:

a fore roller means and aft roller means simultaneously or individually adapted for traction engaging contact with the pipeline, power means coupled to each said roller means for driving the trenching apparatus along said pipeline until an obstacle thereon is countered by said fore roller means, remote control means for selectively withdrawing either of said fore or aft roller means from the surface of the pipeline so that the aft roller means drives the trenching apparatus when the fore roller means is withdrawn and the fore roller means drives the trenching apparatus when the aft roller means is withdrawn to thereby enable the trenching apparatus to move over pipeline obstacles without being removed therefrom.

2. The trenching apparatus of claim 1 wherein one of said fore roller means or aft roller means comprises a pair of depending frame means pivotally supported by and extending from a framework on the trenching apparatus, each said frame means being pivotally mounted so as to enable laterally outward movement thereof with respect to the axis of the pipeline.

3. The trenching apparatus of claim 2 wherein said pair of frame means are respectively coupled to power extension means for selectively pivoting each said frame means outwardly and inwardly by remote control.

4. The trenching apparatus of claim 3 wherein each said frame means may be pivotally connected to the trenching apparatus at any of a plurality of positions laterally of the center line of the pipeline on which the trenching apparatus is intended to rest.

5. The trenching apparatus of claim 4, including a nozzle means for jetting fluid pressure into the floor of the body of water in order to loosen and separate same in preparation for subsequent removal.

6. The trenching apparatus of claim 5 wherein said nozzle means is vertically positionable on said trenching apparatus so as to vary the depth of the jetting function into the floor of the body of water.

7. The trenching apparatus of claim 6 wherein said nozzle means comprises an upper nozzle means and a lower nozzle means, each said upper and lower nozzle means being supplied separately and independently by fluid pressure means so as to maintain equal pressure distribution througout the length of the nozzle means.

* * * * *